US011208227B2

(12) United States Patent
Gigante et al.

(10) Patent No.: US 11,208,227 B2
(45) Date of Patent: Dec. 28, 2021

(54) FOOD PRODUCTS PACKAGING AUTOMATIC PLANT

(71) Applicant: G.D SOCIETA' PER AZIONI, Bologna (IT)

(72) Inventors: Antonio Gigante, Bologna (IT); Luca Cerati, Bologna (IT); Andrea Biondi, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 174 days.

(21) Appl. No.: 16/333,261

(22) PCT Filed: Sep. 20, 2017

(86) PCT No.: PCT/IB2017/055708

§ 371 (c)(1),
(2) Date: Mar. 14, 2019

(87) PCT Pub. No.: WO2018/055531

PCT Pub. Date: Mar. 29, 2018

(65) Prior Publication Data

US 2019/0248528 A1 Aug. 15, 2019

(30) Foreign Application Priority Data

Sep. 20, 2016 (IT) ..... 102016000094153

(51) Int. Cl.
*B65B 59/04* (2006.01)
*B65B 65/00* (2006.01)
(Continued)

(52) U.S. Cl.
CPC ..... *B65B 59/04* (2013.01); *B65B 29/00* (2013.01); *B65B 57/145* (2013.01);
(Continued)

(58) Field of Classification Search
CPC ..... B65B 29/00; B65B 43/00; B65B 57/145; B65B 59/04; B65B 65/003; B65B 65/006;
(Continued)

(56) References Cited

U.S. PATENT DOCUMENTS 5,545,967 A 8/1996 Osborne et al.
8,613,584 B2 * 12/2013 Trebbi et al. ..... B65B 59/04 414/788

(Continued)

FOREIGN PATENT DOCUMENTS

DE 10330700 A1 * 1/2005 ..... B65B 65/003
WO WO-2013/105900 A1 7/2013

OTHER PUBLICATIONS

International Application No. PCT/IB201 7/055708, International Search Report and Written Opinion, dated Dec. 18, 2017.

*Primary Examiner* — Stephen F. Gerrity
(74) *Attorney, Agent, or Firm* — Marshall, Gerstein & Borun LLP

(57) ABSTRACT

A food products packaging automatic plant can have at least a first food products packaging conveying line having a plurality of first connection areas. The plant further comprises a plurality of operative units. Each operative unit has a movable base able to move at the connecting areas; a processing device placed on the movable base and connectable to the conveying line at the connection areas; a plurality of sensors; and a wireless communication device. The plant further includes a maintenance station of the operative units; a preparation station of the operative units; and a control and managing central unit. The control and managing central unit commands the operative units so that they move from and towards the first food products packaging conveying line and from and towards the operative units maintenance and preparation stations.

9 Claims, 1 Drawing Sheet

(51) Int. Cl.
*B65B 29/00* (2006.01)
*B65B 57/14* (2006.01)

(52) U.S. Cl.
CPC ..... *B65B 65/003* (2013.01); *B65B 2210/06* (2013.01); *B65B 2220/14* (2013.01)

(58) Field of Classification Search
CPC ..... B65B 2210/06; B65B 2220/14; G05B 2219/45048
USPC .... 53/52, 167, 201, 202, 249, 250, 282, 493
See application file for complete search history.

(56) References Cited

U.S. PATENT DOCUMENTS

| | | | | |
|---|---|---|---|---|
| 8,616,824 | B2 * | 12/2013 | Trebbi et al. | B65B 59/04 414/331.06 |
| 9,358,975 | B1 | 6/2016 | Watts | |
| 2003/0029139 | A1 * | 2/2003 | Ng et al. | B65B 55/24 53/167 |
| 2005/0210832 | A1 * | 9/2005 | Tassin et al. | B65B 59/001 53/201 |
| 2011/0078979 | A1 * | 4/2011 | Hutter | B65B 59/04 53/201 |
| 2015/0052848 | A1 * | 2/2015 | Vine | B65B 59/04 53/329 |
| 2016/0251101 | A1 | 9/2016 | Kong et al. | |

* cited by examiner

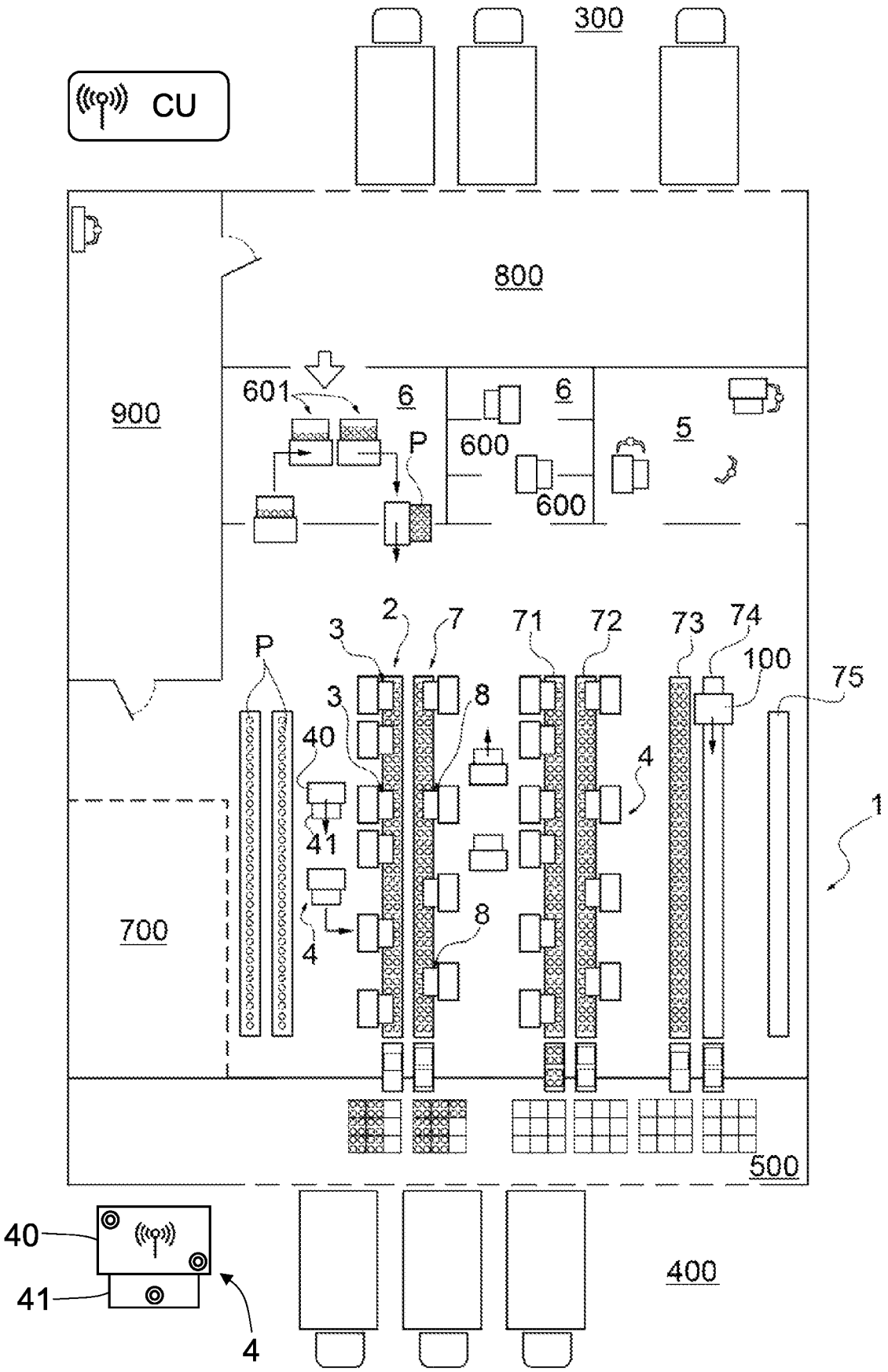
300
CU
800
900
601
6
6
P
600
600
5
2
7
71
72
73
74
100
75
3
3
8
40
4
41
1
700
8
4
500
40
41
4
400

FOOD PRODUCTS PACKAGING AUTOMATIC PLANT

CROSS-REFERENCE TO RELATED APPLICATIONS

This is U.S. national phase of International Application No. PCT/IB2017/055708, filed Sep. 20, 2017, which claims the benefit of Italian Patent Application No. 102016000094153, filed Sep. 20, 2016.

TECHNICAL FIELD

The present invention falls within the food products packaging technical field. In detail, the invention relates to a food products packaging automatic plant.

PRIOR ART

In the packaging field, and, more specifically in the food products packaging field, the need for productive diversification is increasingly felt. Considering for example, products such as yogurt, coffee capsules, etc., it is possible to find a variety of types on the market, both in terms of a packaging point of view and in terms of the variety of the contained product. This translates into the need to have means available to allow said diversification. In the case of yogurt, for example, it may be necessary to replace the containers (cups), which can have different shapes, and/or their contents.

In addition, since this production diversification is usually related to specific production batches rather small, there is a further need to rapidly modify the packaging plant.

Nowadays it is particularly difficult to meet the above-mentioned requirements: in fact, the time required to make changes to the packaging plant is prolonged. In addition, numerous especially selected operators are required to intervene.

At present, products of a particular type are processed in packaging lines where a plurality of stations are arranged in cascades (loading, dosing, sealing, etc.).

In the case wherein is necessary to change the product to be packaged, it is necessary to intervene on the plant by arranging operations such, for example, the washing of the stations that contribute to the filling of the product in the packaging, as well as the adaptation of the processing means acting on the products.

In particular, the washing of the dosing means can be done in line ("Cleaning in place") or out of line ("Cleaning out of place"). In the first case, the plant provides a shower system inside the dosing assembly that is activated automatically. At the end of a washing cycle (with an average period of approximately one hour) it is necessary to check its effectiveness to avoid contamination. If the check fails, the washing cycle must be repeated.

In the second case, the dosing means is designed to be dismantled and brought to a specific area, where it is washed, usually manually, and then reassembled on the line. Also in this case, it is possible to check the effectiveness of the washing.

It is clear that all these operations are complicated and require considerable downtime.

The same happens in case of malfunctions and/or maintenance of the individual stations of the plant. Also in these cases, in fact, the plant remains stopped for a considerable time, at the expense of the overall productivity.

In addition, the presence of the operators on existing lines requires the application of protections on the machines for operator safety. Said protections are expensive, often have a large surface area and must be washed frequently for hygiene reasons.

The known art solutions are then less flexible and, therefore, unsuitable for productive diversification.

Patent Application WO2013105900A1 describes a flexible packaging line in which food or non-food articles are automatically fed, by means of robot arms, to corresponding trays advanced by a horizontal conveyor.

Patent Application US2016251101A1 describes a packaging line in which food or beverages are fed to corresponding trays advanced by a horizontal conveyor.

DESCRIPTION OF THE INVENTION

The object of the present invention is to overcome the aforementioned drawbacks.

Said object is achieved by proposing a food products packaging automatic plant according to the appended claims.

Advantageously, the food products packaging automatic plant proposed by the invention allows for the diversification of production with rapid times with respect to the known art. Moreover, the intervention of a number of especially selected operators to carry out the predisposition of the plant to said diversification, is not necessary.

Additionally, with the invention, the downtimes necessary for the maintenance/replacement operations of the parts of the plant are considerably reduced.

In addition, with the automatic plant proposed by the present invention, the protections for the operators are not necessary as, in the known art, they were expensive and unproductive, both because they had to be washed frequently, and because they also occupied a lot of space.

Therefore, the packaging automatic plant according to the present invention is particularly flexible, in particular it can be quickly configured for any need.

BRIEF DESCRIPTION OF THE DRAWINGS

Further advantages will be apparent in the following discussion, with the help of the attached drawing, wherein:

the FIGURE is a schematic plan view of a food products packaging automatic plant according to a preferred embodiment of the invention.

PREFERRED EMBODIMENTS OF THE INVENTION

With reference to the accompanying FIGURE, number 1 denotes as a whole, a food products packaging automatic plant according to the present invention. The plant 1 comprises at least a first food products P packaging conveying line 2 comprising a plurality of first connection areas 3. The automatic plant 1 further comprises a plurality of operative units 4, each comprising: a movable base 40 which is able to move at the first connection areas 3 of the first food products P packaging conveying line 2; processing means 41, placed on the movable base 40 and connectable to the first packaging conveying line 2 at the first connection areas 3. The processing means 41 are arranged to perform a packing processing (e.g. filling, capping, sealing, etc.) on packages of the food products P passing through the first packaging conveying line 2. Each movable unit 4 further comprises a plurality of sensors and wireless communication means.

In addition, the plant 1 further comprises: at least a maintenance station 5 of the operative units 4; at least one preparation station 6 of the operative units 4; and a control and managing central unit CU. The latter in turn comprises: wireless communication means, for sending and receiving information to and from the operative units 4, and an internal memory, in which predetermined information are stored.

In detail, the control and managing central unit CU, based on the information sent and received to and from the operative units and based on the predetermined information stored in the internal memory, commands the operative units 4 so as to move, by means of the respective movable base 40, from and towards the first food products P conveying line 2 and from and towards the operative units 4 maintenance 5 and preparation 6 stations.

Advantageously, the operative units 4, configured as above, are able to move independently from and toward the first food products P conveying line 2 due to the control and managing central unit CU.

In addition, the operative units 4 can also move independently from and towards the maintenance 5 and preparation 6 stations.

In this way, if there is a need for variation in production or maintenance and/or other interventions on the plant 1, not only especially selected operators are not needed, but, furthermore, the plant 1 itself is able to intervene suddenly to replace the operative units 4. For example, operative units 4, provided for a certain type of processing, are replaced with others, or malfunctioning operative units 4 are replaced with functioning operative units 4. Additionally, operative units 4 that have exhausted their respective material (filler product, containers, lids, etc.) are replaced with other loads with the corresponding material. The operative units 4 can be provided at each connection area 3: this means that the processing means 41 can be provided at any useful point of the first packaging conveying line 2 (defined, exactly, by the corresponding connection area 3).

Advantageously, this aspect offers a high flexibility to the plant 1.

As an example, in the case it is needed to switch from filling packages with just one product (e.g. yogurt) to filling the same packages with two different products (e.g. yogurt and fruit and/or cereals). In this case, it is necessary to modify the layout of the plant 1 by adding processing means 41 dedicated to fill the second product in the package along the first food products P conveying line 2.

In the area of the first connection areas 3 (which can be in any number, at predetermined distances), all means necessary for the connection of the processing means (e.g. electrical, pneumatic or other power supply connections, etc.) are provided to the first conveying line 2.

At the first connection areas 3, centering means are also provided, which represent a positioning reference, with adequate precision, for the operative units 4, thus ensuring the correct functioning of the processing means 41.

The first connection areas 3 represent references for the operative units 4. The fact that the operative units 4 (and in particular the respective movable bases 40) are provided with sensors, for example optical sensors, allow them to move in the plant 1 and therefore also to suitably move at the connection areas 3.

The operative units 4 can also have a positioning system relative to the products. In fact it is known that conveyors, due to wear, are subject over time, to changes in the pause positions where the processing takes place. If the products stop in a slightly shifted position with respect to the theoretical one, this can result in scraps. Even the non-perfect mechanical construction of the conveyor can cause the same drawback. In order for each operative unit 4 to be able to avoid scrap due to the inaccurate relative positioning with the product, it can be provided with sensors that detect the position of the product as well as with a position correction system (even in real time) for the operative means of the unit itself.

For example, the operative units 4 are provided with different means to enable proper movement and correct positioning of the same in different situations. These means, to which different levels of precision correspond, are: navigational means, i.e. navigational aids with sufficient precision for avoiding obstacles and for allowing the movement of the movable bases 40 within the system; alignment means, i.e. aids (e.g. optical means) for the positioning of the movable bases 40 so that the respective processing means 41 are aligned with the first connection areas 3; and engaging means, i.e. mechanical aids, which allow the processing means 41 to mechanically connect the first connection areas 3 (for example, mechanical guides that accompany the processing means 41 up to connecting the latter with the first conveying line 2). The sensors and the wireless communication means also allow the detection of situations and/or conditions that are then communicated to the central unit CU (e.g. a malfunction).

In particular, the sensors can be of two types:

- sensors needed for production functioning (presence, counting, jam detection of the product), and these are positioned on the processing means 41; or
- sensors necessary for handling the plant (scanners, obstacles detection, bumper), and these are positioned on the movable base 40.

The movable base 40 is for example a cart on which the processing means 41 are arranged.

According to an embodiment of the invention, each movable base 40 is provided for supporting the corresponding processing means 41 even when the latter are connected at a first connection area 3. In this case each movable base 40 and the corresponding processing means 41 form a single unit.

According to one alternative, each movable base 40 is adapted for moving away from the first conveying line 2 when the respective processing means 41 are connected at a first connection area 3. In this case, therefore, each movable base 40 is used solely for the transport of the processing means 41 and, advantageously, after this operation, is available to perform another one. This solution, therefore, allows providing and using a lesser number of movable bases 40 for the functioning of the plant 1 with respect to the previous case.

Preferably, the automatic plant 1 according to the invention further comprises at least a second food products P packaging conveying line 7 comprising a plurality of second connection areas 8. In particular, the processing means 41 of the operative units 4 can also be connected to the second packaging conveying line 7 in the area of the second connection areas 8 and are provided for processing also the food products P that passes through the second packaging conveying line 7. In this case, the control and managing central unit CU commands the operative units 4 so that they also move from and towards the second food products P packaging conveying line 7 (always based on the information sent and received to and from the operative units and based on predetermined information stored in the internal memory).

Advantageously, the processing means 41 of each operative unit 4 can be connected both to the first connection areas 3 of the first food products P packaging conveying line 2 and to the second connection areas 8 of the second food products P packaging conveying line 7 in an equivalent manner.

This means that the first food products P packaging conveying line 2 and the second food products P packaging conveying line 7 can share the same processing means 41, further optimizing the flexibility of the plant 1.

Clearly, the plant 1 can comprise more than two products packaging conveying lines, as in the case illustrated in FIG. 1, wherein further conveying lines 71, 72, 73, 74, 75 are provided with an equal number of connection areas (not illustrated).

In any case, the processing means 41 of the operative units 4 are provided for connecting to each connection area of products packaging conveying line. The processing means 41 are means dedicated to perform a single operation (high efficiency), unlike multifunction robots. In general, an automatic-machine processing unit offers greater efficiency than an anthropomorphic robot, i.e., in a specific operation, the processing unit of an automatic machine has an average cost per unit of product produced, lower than the anthropomorphic robot (i.e. with respect to the latter, it manages to perform more complex processing in a shorter time).

Preferably, the preparation station 6 comprises a washing assembly 600, for washing the operative units 4, in particular the processing means 41. The washing operation is very important in the food industry and can also require several consecutive washing cycles, if the first washing cycle is not sufficiently effective, to guarantee the correct hygiene of the processing means 41 (as described in the introductory part of this discussion).

In the case of needing to wash the processing means 41 (dosing assembly), for example because it is necessary to change the food to be packaged, the latter are independently disconnected from the feeding line 2, 7 to be directed (by means of a corresponding movable base 40) to the washing assembly 600. At the same time, another operative unit 4 comprising suitable processing means 41, can be provided (by means of a movable base 40) for example in replacement of the previously indicated unit, at a connection area 3, 8 so that the respective processing means 41 act on the food products P (in this case for the dosing of another product). It is clear that, in this way, the production interruption is irrelevant. In fact, the washing of the processing (dosing) means and the checking of the washing are carried out in the preparation station 6 automatically and without requiring the dosing assembly to be disassembled from the operative unit. Meanwhile, the plant 1 does not stop the production, as another operative unit 4 can connect independently to the first or second feeding line 2, 7. Further dosing devices can be coupled if necessary.

Preferably, the tank with the product to be dosed is filled in a specific area of the preparation station 6 without the need to prepare tubes, valves, and aerial supports that are usually provided in the traditional plant for feeding the product in the area of the line.

For example, the preparation station 6 can also comprise a loading and unloading assembly 601 for loading and unloading material on and from the operative units. For example, the loaded and/or unloaded material can consist of yogurt cups, lids/container closing elements, or of food products to be introduced inside the container.

For example, the loading and unloading assembly 601 comprises a filling station of the dosing unit for supplying the food product to be introduced inside the containers.

The presence of the loading and unloading assembly 601 is particularly advantageous. In fact, in the known art, the materials to be loaded were carried on pallets near the loading area. The actual loading was mostly carried out by an operator, which took a long time to perform as this was a tiring operation. Sometimes, loading was also carried out with the help of anthropomorphic robots or other automatic devices. In addition, it was often necessary to unload the materials off the plant during prolonged stops, for example for size changes and during the prolonged stops. In automatic plant 1, however, the loading/unloading of materials can be done in a fully automated manner without the need of any operator.

In addition, said material loading/unloading system is centralized, so it can reduce the costs of automation and/or labor unlike individual automation systems.

The presence of the control and managing central unit CU is fundamental, as it allows to centralize all the information of the plant 1, i.e. to have a complete picture of the situation, to accordingly manage the plant 1 (e.g. activating operative units 4).

Various information can be stored in the internal memory of the central managing and control unit, such as:

- the layout of the plant 1;
- the total number of operative units 4;
- the type of processing means 41 required for the packaging of a particular type of product.

The control and managing central unit CU, furthermore, can receive and send information from and to external units (e.g. logistic chain). All data is collected, stored and processed to be analyzed by suitable algorithms to extract the information required.

In other words, the control and managing central unit CU can in turn be connected with a data processing and storing infrastructure external to the automatic plant 1 to allow the use of resources not available on the single plant (i.e. provides the so-called "cloud computing").

Since the possibility of using this data in order to adapt the production plant is limited by the structural rigidity of the latter, the proposed automatic plant 1 is optimal. In fact, by inputting external variable data related to logistics in the management of the plant 1, a greater overall quality is ensured.

The automatic plant 1 object of the invention also allows to package products very different from one another, such as yoghurt jars and coffee capsules. This type of "product change" is incompatible with the constructive design of known machines, which are provided for the packaging of only one type of product. Therefore, if said product variation in known machines is to be performed, invasive structural changes on the whole plant need to be carried out with very high costs and time, without the possibility of flexible reconfiguration of the machine.

With reference to the operations to be carried out (by way of example) for the change of product to be packaged from yogurt jars to coffee capsules, it is necessary first to reconfigure the existing conveying lines. In fact, plates are provided on the conveying lines, which are provided with housings sized according to the container to be transported (jars or capsules). To this end, the plant 1 comprises a plate change assembly (not illustrated), which is autonomously positioned closely to the conveying line (one or more) and serves to remove the plates with the housings for yogurt jars and to replace those with housings for coffee capsules. The plate change assembly comes from a stop station 700, for example.

Thus, the plate change assembly, as well as the processing means 41 dedicated to yogurt, move to the washing assembly 600 in the preparation station 6 due to a corresponding movable base 40. At the same time, the processing means 41 for the packaging of coffee capsules (e.g. powdered coffee hopper-feed screw, means for sealing the round lid having the coffee capsule diameter, etc.) engage the conveying lines 2, 7.

With reference to the example in the FIGURE, the automatic plant 1 further comprises: a storage area for materials 800 from which the materials (products or parts of them) are conveyed towards the loading/unloading assembly 601 of the preparation station 6; an office area 900; two areas 300, 400 in which the incoming materials and the output food products P are respectively stalled, for example, an area where trucks can be placed with output food products P; a palletizing area 500 of packaged food products P.

A device 100 for washing the conveying lines 2, 7, 71, 72, 73, 74, 75 can also be provided. Said device is movable along the lines, as schematically illustrated in the attached FIGURE.

The proposed automatic plant 1, therefore, is particularly advantageous compared to traditional plants for several aspects, primarily for the possibility of automatic reconfiguration that makes the plant 1 particularly flexible.

Preferably, at the end of each conveying line an unloading system is provided managed by a robot that can pick up the products and place them on a pallet or feed a different line (e.g., for subsequent steps of the process).

In addition, the plant 1 reduces/eliminates the stop times during the necessary cleaning and maintenance operations. In fact, as mentioned above, these operations are performed in specific areas of the plant 1 autonomously while other operative units engage the feeding lines. All this is ensured by the fact that the operative units are independent of each other and interchangeable on the feeding line.

Logistics operations within the plant (loading/unloading/transporting of materials) are also optimized, and do not require operator intervention. The total number of operators required inside the plant 1 is therefore significantly reduced compared to the known art.

In addition, connections with external units allow optimal management of the plant 1 by means of the control and managing central unit.

The invention claimed is:

1. A food products (P) packaging automatic plant (1) comprising:

a first food products (P) packaging conveying line (2), comprising a plurality of first connection areas (3);

a plurality of operative units (4), each comprising: a movable base (40), that is able to move at the first connection areas (3) of the first food products (P) packaging conveying line (2); processing means (41), placed on the movable base (40) and connectable to the first conveying line (2) at the first connection areas (3), for performing a packing operation; a plurality of sensors; and wireless communication means;

connecting means for connecting the processing means to the first conveying line (2) and wherein the connecting means are arranged in correspondence of the plurality with first connection areas (3);

at least a maintenance station (5) of the operative units (4);

at least one preparation station (6) of the operative units (4); and a control and managing central unit (CU) that comprises: wireless communication means, for sending and receiving information to and from the operative units (4); and an internal memory, in which predetermined information is stored;

wherein the control and managing central unit (CU), on the basis of the information sent and received to and from the operative units (4) and of the predetermined information stored in the internal memory is able to command the operative units (4) so that they move from and towards the first food products (P) packaging conveying line (2) and from and towards the operative units (4) maintenance (5) and preparation (6) stations;

wherein the processing means (41) of each operative unit (4) is arranged to perform the packing operation on the food products (P) packaging conveyed on the first food products (P) packaging conveying line (2); and wherein each movable base (40) and the corresponding processing means (41) form a single unit so that each movable base (40) is provided for supporting the corresponding processing means (41) even when the processing means (41) is connected by the connecting means at one of the first connection areas (3).

2. The automatic plant (1) according claim 1, wherein the preparation station (6) comprises a washing assembly (600) for washing the processing means (41) of the operative units (4).

3. The automatic plant (1) according to claim 1, wherein the preparation station (6) comprises a loading and unloading assembly (601) for loading and unloading materials on and from the operative units (4).

4. The automatic plant (1) according to claim 3, wherein the loading and unloading assembly (601) comprises a filling station.

5. The automatic plant (1) according to claim 1, wherein:

the means for connecting the processing means (41) to the first conveying line (2) comprises electric and pneumatic connecting means; and each of the first connection areas (3) comprises centering means, which identify a reference for the operative units (4).

6. The automatic plant (1) according to claim 1, wherein the control and managing central unit (CU) receives and sends information from and to units that are external to the plant (1).

7. The automatic plant (1) according to claim 1, further comprising a second food products (P) packaging conveying line (7), comprising a plurality of second connection areas (8); the processing means (41) of the operative units (4) being connectable also to the second conveying line (7) at the second connection areas (8) and being able to process also the food products (P) packaging conveyed on the second conveying line (7); the control and managing central unit (CU) is able to command the operative units (4) so that they move also from and towards the second food products (P) packaging conveying line (7).

8. The automatic plant (1) according to claim 1, wherein the packing operation performed by the processing means (41) comprises filling, capping or sealing a package of the food products (P) conveyed on the first food products (P) packaging conveying line (2).

9. The automatic plant (1) according to claim 1, wherein each processing means (41) is dedicated to perform a single operation.

* * * * *